US005273479A

United States Patent [19]

Chang

[11] Patent Number: 5,273,479

[45] Date of Patent: Dec. 28, 1993

[54] MOVING AND DANCING DOLL

[76] Inventor: Pei H. Chang, 2048 Coyne St., Honolulu, Hi. 96826

[21] Appl. No.: 932,322

[22] Filed: Aug. 18, 1992

[51] Int. Cl.[5] ..... A63H 5/00; A63H 11/12; A63H 17/25; A63H 3/28

[52] U.S. Cl. ..... 446/272; 446/278; 446/287; 446/288; 446/298

[58] Field of Search ..... 446/269, 270, 272, 278, 446/279, 280, 287, 288, 297, 298, 303

[56] References Cited

U.S. PATENT DOCUMENTS

| | | | |
|---|---|---|---|
| 237,897 | 2/1881 | Pfanne | 446/287 |
| D. 294,057 | 2/1988 | Kim . | |
| D. 315,933 | 4/1991 | Sung . | |
| 1,251,458 | 1/1918 | Ahern | 446/287 |
| 1,422,855 | 7/1922 | Haskell . | |
| 1,430,811 | 10/1922 | Johnson et al. . | |
| 1,499,485 | 7/1924 | Strauss et al. . | |
| 1,746,056 | 2/1930 | Sessler | 446/288 |
| 1,888,005 | 7/1931 | Markey et al. | 446/270 |
| 2,487,940 | 1/1947 | Pacheco | 446/287 |
| 3,787,999 | 1/1974 | Ayton et al. . | |
| 3,984,939 | 10/1976 | Wolgamot et al. . | |
| 4,186,516 | 2/1980 | Ensmann . | |
| 4,355,482 | 10/1982 | Sapkus et al. . | |
| 4,545,775 | 10/1985 | Kim . | |
| 4,676,764 | 6/1987 | Yeu . | |
| 4,778,432 | 10/1988 | Yeu . | |
| 4,801,285 | 1/1989 | Yeu . | |
| 4,824,416 | 4/1989 | Chun-Hoi et al. . | |
| 4,875,886 | 10/1989 | Sung . | |
| 4,954,117 | 9/1990 | Daleus et al. | 446/280 |

OTHER PUBLICATIONS

J. H. Upsun Co., Ltd.—Copyright Registration No. VAu 67-029 dated Nov. 16, 1984.

Michael & Park's Trading & Sales, Inc.—Copyright Registration No. VA 245-560 dated Apr. 7, 1986.

*Primary Examiner*—Robert A. Hafer
*Assistant Examiner*—Gregory M. Stone
*Attorney, Agent, or Firm*—Martin E. Hsia

[57] ABSTRACT

A doll (10) that dances by reciprocating a hip portion (20) and that simultaneously moves along a surface (S) in a generally curving path. The doll has a base (40) with a drive wheel assembly (70) and a crank (55) that reciprocates the hip portion (20). Preferably, the doll (10) also has sound emitting means (110).

18 Claims, 3 Drawing Sheets

MOVING AND DANCING DOLL

DESCRIPTION

1. Technical Field

This invention relates to a doll that moves along a surface and dances. Preferably, the doll moves along the surface in a generally curving path. p 2. Background Art There has been a long felt need to make dolls that dance in a lifelike manner. Many patents have been issued for dolls that dance, usually by reciprocating their hips.

U.S. Pat. No. 1,499,485 to Strauss discloses a motor driven support representing a boat, vehicle or other object upon which is mounted a figure arranged to dance or jig while the support is in motion.

U.S. Pat. No. 4,545,775 to Kim discloses a dancing hula doll that alternatively moves its hips left and right and rotates on a stationary base while playing music.

U.S. Pat. No. 4,676,764 to Yeu discloses a dancing doll with hip movement using a cranking shaft to move an actuator up and down in a bracket, which in turn moves an actuator rod.

U.S. Pat. No. 3,787,999 to Ayton discloses a device for receiving a doll's feet and reciprocating them which includes a wheel that is swiveled by a mounting ring that can be grasped and pushed to move the device over a supporting surface.

U.S. Pat. No. 1,430,811 to Johnson discloses a doll having movable limbs to be used in connection with the operation of phonographs.

U.S. Pat. No. 4,186,516 to Ensmann discloses a toy doll to simulate the skating movements of an ice skater which is positioned on a stand where movement of the stand will cause the torso to pivot about one leg.

U.S. Pat. No. 4,355,482 to Sapkus discloses a doll that simulates roller skating having a motor in each leg to drive the roller skates.

U.S Pat. No. 3,984,939 to Wolgamot discloses a toy automobile having a figure detachably attached thereto and a skid inducing wheel.

U.S. Pat. No. 1,422,855 to Haskell discloses a shimmy doll having a wind up motor that operates a shaker bar to agitate a skirt sideways.

U.S. Pat. No. 4,875,886 to Sung discloses a hula doll that sways from right to left about a pivot point in a stationary interior upper torso portion, oscillates slowly clockwise and counter clockwise about a vertical axis and has arms that wave up and down in opposite directions and also includes a sound emitting device.

U.S. Pat. No. 4,778,432 to Yeu discloses a doll simulating a drummer that appears to beat a drum with its hands and rotate its head, while a melody is playing.

U.S. Pat. No. 4,801,285 to Yeu discloses a hula doll with a three position switch that moves its hips left and right while turning counter clockwise and that generates a Hawaiian melody.

U.S. Pat. No. 4,824,416 to Chun-Hoi discloses two dancing keiki dolls in which one of the dolls shakes its hips left and right while the other simultaneously moves its legs towards and away from each other.

U.S. Des. Pat. No. 294,057 to Kim, U.S. Des. Pat. No. 315,933 to Sung, Copyright Registration VAu 67-029 to J. H. Upsun, Co., Ltd. and Copyright Registration VA 245-560 disclose ornamental designs for hula dolls.

Except for the patent to Strauss, all of the dancing dolls disclosed by the foregoing patents remain stationary on a surface while dancing, although some rotate while remaining in a fixed location on that surface. However, it is well known that real dancers do not remain stationary while dancing, but rather move along a surface, usually the floor. Strauss requires an additional device, such as a boat or other vehicle, which prevents the doll from having the realistic appearance of a person dancing on a surface. The skating dolls disclosed by the foregoing patents do not dance by moving their hips.

It is therefore an object of this invention to provide a doll that both dances and moves along a surface to provide a more realistic simulation of a real dancer.

DISCLOSURE OF INVENTION

The doll of this invention comprises a base, base moving means operatively connected to the base for moving the base along a surface, a hip portion reciprocatably supported above the base and hip reciprocating means operatively connected to the hip portion for reciprocating the hip portion. Preferably the base moving means and hip reciprocating means are driven by an electric motor through base movement reduction means and hip reciprocation reduction means to obtain reciprocation of the hip portion and movement of the base at desired speeds. Preferably the hip portion resembles the hip portion of a human and the doll also includes an upper portion supported above the hip portion that resembles the torso of a human, with a head and arms movably attached. Preferably, also, sound emitting means are provided in the base for emitting sounds while the doll is in operation, preferably music. Preferably the base moving means moves the base in a generally curving path and away from any obstacles it might encounter while moving along the surface. Preferably, also, the hip reciprocating means comprises a transmission member connected to a crank at one end and to the hip portion at the other end.

Other objects, features, and advantages of the present invention will become more fully apparent from the following detailed description of a presently preferred embodiment for carrying out the invention, the claims and the accompanying drawings.

BEST MODE FOR CARRYING OUT INVENTION

The best mode presently contemplated for carrying out the present invention is illustrated by way of example in FIGS. 1–4.

Figure 1:
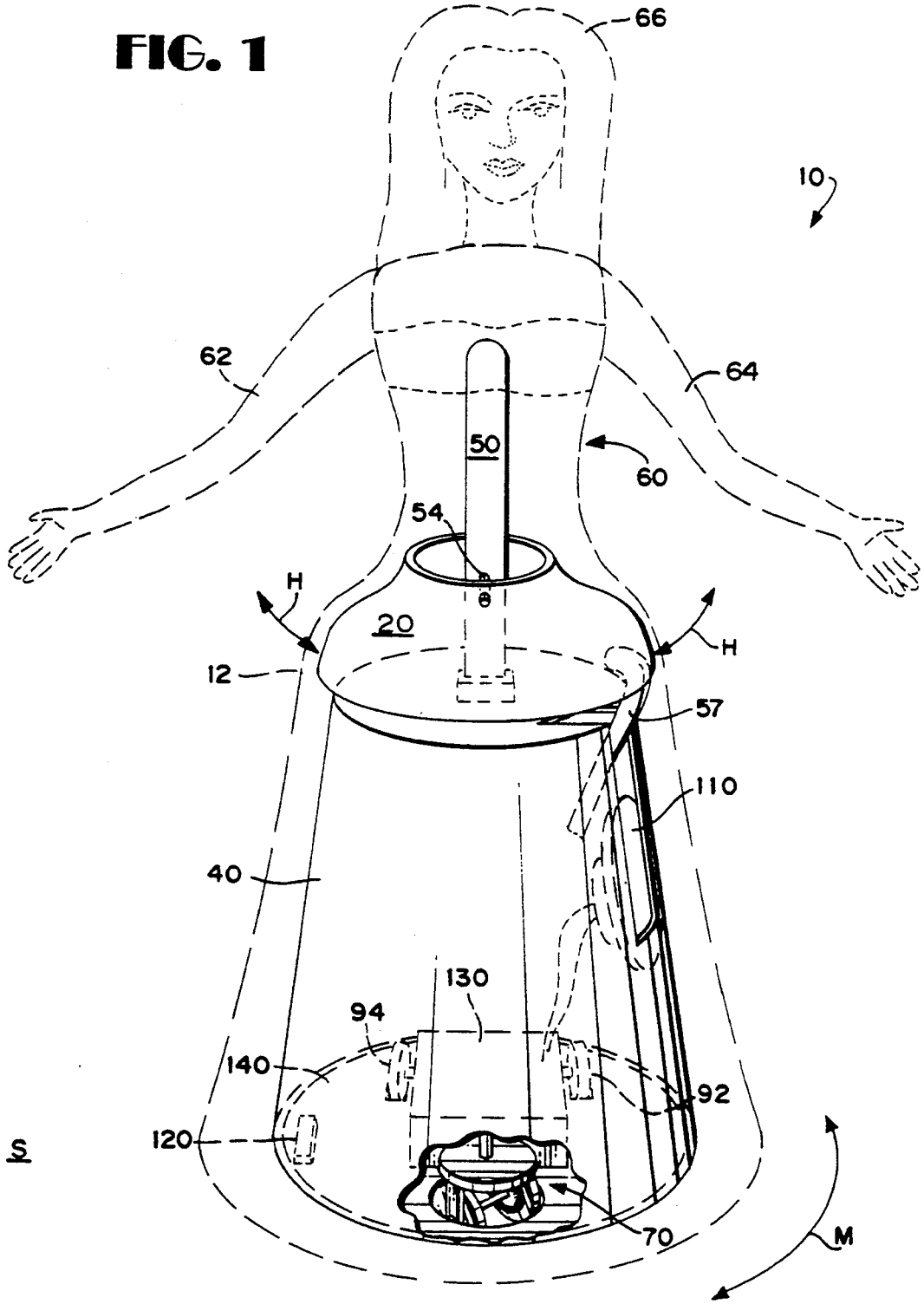
FIG. 1 is a front perspective view of a preferred embodiment of the present invention generally indicating the shaking of the hips, movement along a surface, the general structure of the base and showing the drive wheel configuration in cut away.

Referring to FIG. 1, shown is a front perspective view of a doll 10 according to the present invention having clothing 12 covering a hip portion 20 and a base 40. The base 40 preferably is in the shape of a truncated cone. A support member 50 is mounted on top of the base 40 and the hip portion 20 is reciprocatably mounted above the base by being pivotably attached at an intermediate part of the support member 50 at pivot point 54. An upper body portion 60 resembling the torso of a human is attached to the top of the support member 50. A head portion 66 resembling the head and neck of a human, and two arms 62 and 64 are attached to the upper body portion. Preferably the arms 62 and 64 and the head 66 are movably attached to allow a variety of poses. The arrow H generally designates the reciprocating motion of the hip portion 20 transverse to the support member 50.

The base 40 preferably includes a drive wheel assembly 70 (shown generally in a cut away view) and two support wheels 92 and 94 (thus defining a triangle with the drive wheel assembly 70) that allow the base 40 to move along a surface S in the manner generally indicated by the arrow M, thus following a generally curving path.

Preferably the base 40 also is provided with conventional sound emitting means (generally designated as 110) for emitting sound, preferably music, while the doll is in operation. Such sound emitting means could include an integrated circuit chip (IC chip) connected to a speaker, as taught, for example, by U.S. Pat. Nos. 4,545,775 to Kim, 4,801,285, 4,778,432, and 4,676,764 to Yeu and 4,875,886 to Sung, all of which are incorporated herein by reference.

The doll 10 preferably includes a conventional slide switch 120 and a conventional battery compartment 130 in the bottom 140 of the base 40.

Figure 2:
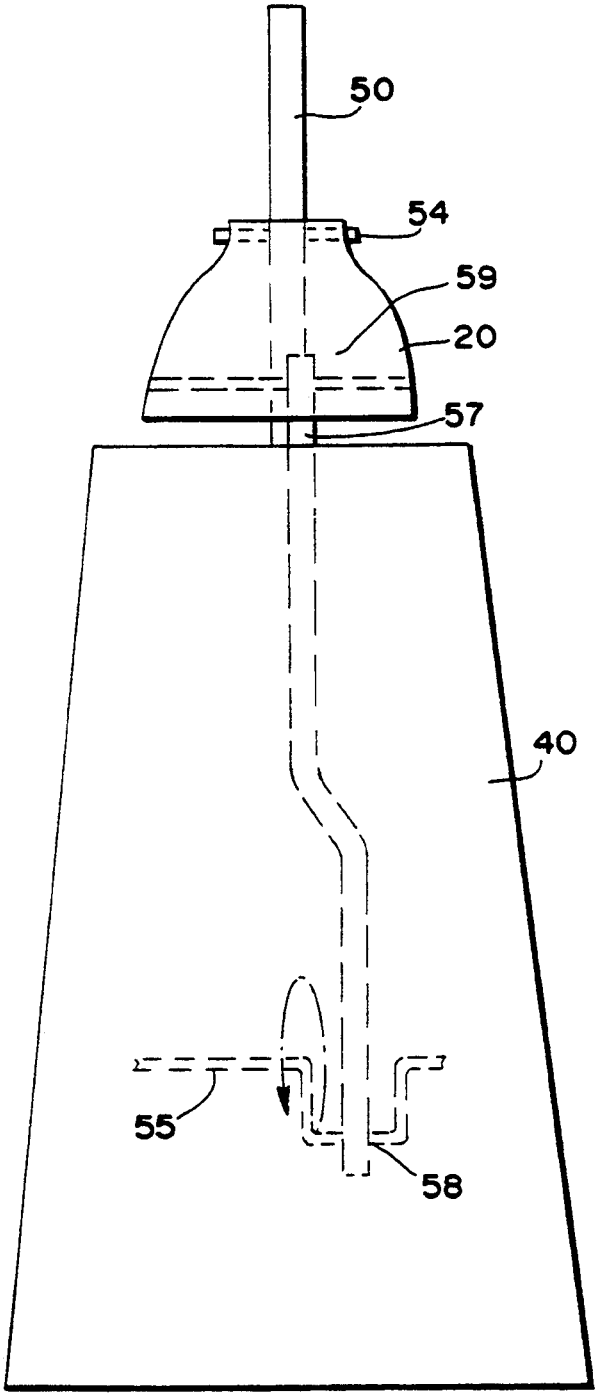
FIG. 2 is a general schematic representation of the hip reciprocating means for reciprocating the hip portion of the doll.

Referring to FIG. 2, generally shown is the hip reciprocating means. The hip portion 20 is reciprocatably supported above the base 40 by being pivotably attached at pivot point 54, as noted above. A crank 55 in the base 40 is driven into rotation by a motor through hip reciprocation reduction means (see FIG. 3) and the rotational motion of the crank 55 is transmitted to the hip portion 20 by transmission member 57 which is rotatably attached to the crank 55 at a crank end 58 and rotatably attached to one end of the hip portion 20 at a hip end 59. Thus, the rotational movement of the crank 55 causes the hip portion 20 to reciprocate.

Figure 3:
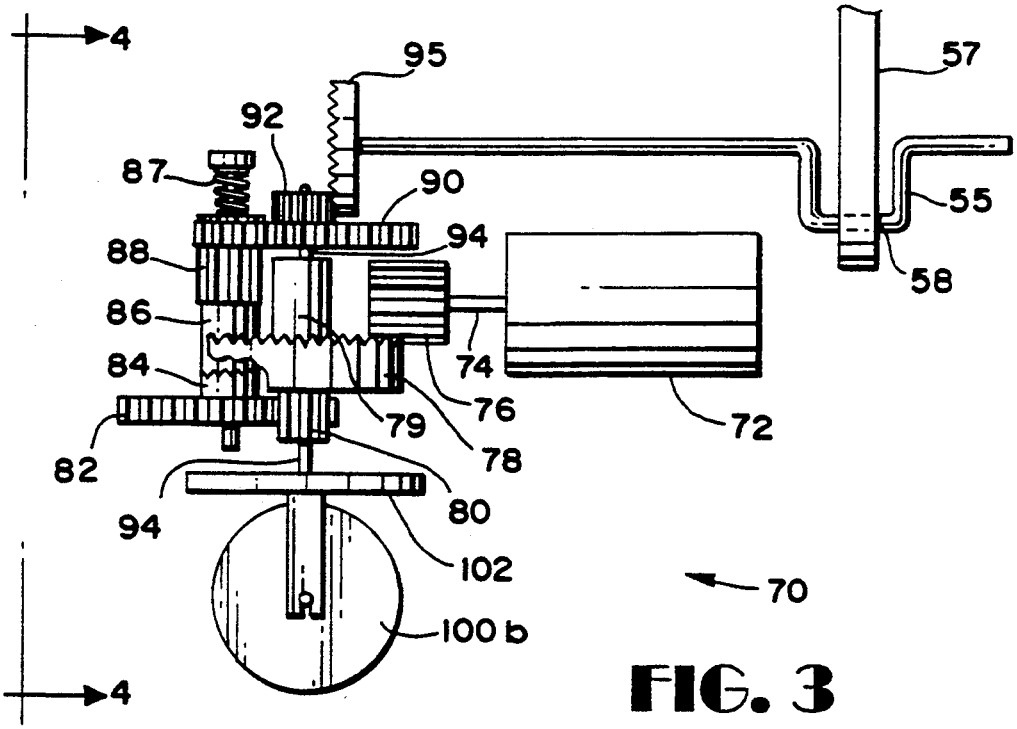
FIG. 3 is a side elevational view of the motor and gears used to achieve the motion shown in FIG. 1 with the base and other supporting structures omitted for clarity.
Figure 4:
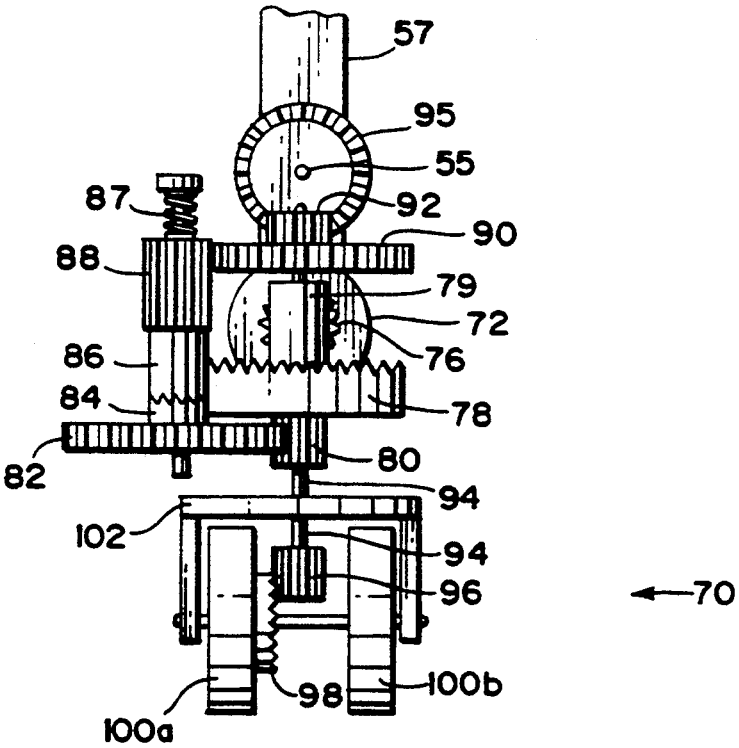
FIG. 4 is an end view along the line 4—4 of FIG. 3.

Referring to FIGS. 3 and 4, shown is the presently preferred embodiment of the base moving means, base movement reduction means, hip reciprocating means and hip reciprocation reduction means, with the base 40 and other supporting structure (which is conventional in any event) omitted for clarity.

Preferably the base moving means and hip reciprocating means are driven by a single conventional electric motor 72 that rotates a shaft 74 (although separate motors could obviously be employed). However, the rotational speed of a conventional electric motor 72 is usually too high for a dancing doll, and therefore the rotational speed of the electric motor's shaft 74 must be reduced to obtain reciprocating motion of the hip portion 20 at the desired speed and generally curving motion of the base 40 at the desired speed. Thus, base movement reduction means and hip reciprocation reduction means that reduce the rotational speed of the electric motor's shaft 74 are operably connected between the shaft 74 of the electric motor 72 and the hip reciprocating means (crank 55 and transmission member 57) and the base moving means (drive wheel assembly 70).

Although any base movement reduction means for driving the base moving means at the desired speed and any hip reciprocation reduction means for driving the hip reciprocating means at the desired speed (as well as any base moving means and any hip reciprocating means) can be used, described is the presently preferred embodiment of such reduction means (and such moving and reciprocating means). The described embodiment is preferred because it minimizes the number of parts necessary to simultaneously perform the desired functions of reducing the rotational speed of the shaft 74 of the electric motor 72 to the desired speed, translating that reduced rotational speed into reciprocating motion of the hip portion 20, and transmitting that reduced rotational speed to the drive wheel assembly 70. However, the following description is deemed to encompass any equivalents of the disclosed means (such as pulleys and belts or different combinations of gears) that would be recognized by a person of ordinary skill in the art.

A motor spur gear 76 is preferably mounted on the shaft 74 of the electric motor 72 and is drivingly engaged with a motor crown gear 78 that has a motor pinion gear 80 coaxially attached. The motor pinion gear 80 in turn is drivingly engaged with a motor drive gear 82. Thus, the rotation of the shaft 74 becomes reduced and transformed into rotation of the motor drive gear 82.

The provision of a clutch mechanism between the motor drive gear 82 and the hip reciprocating means and base moving means is preferred in case parts of the hip reciprocating means or base moving means are jammed or do not operate smoothly. Accordingly, a clutch crown gear 84 is preferably coaxially mounted on the motor drive gear 82 and a doll movement crown gear 86 complementary to the clutch crown gear 84 is slidably mounted coaxially with the clutch crown gear 84. Biasing means, such as a spring 87, then biases the doll movement crown gear 86 into driving engagement with the clutch crown gear 84.

The doll movement crown gear 86 is preferably provided with an integrally formed coaxial doll movement pinion 88, which is in driving engagement with a doll movement main gear 90 mounted for coaxial but independent rotation from the motor crown gear 78 and motor pinion gear 80. A hip movement pinion gear 92 and a base movement transmission shaft 94 are coaxially attached to the doll movement main gear 90. The hip movement pinion gear 92 is in driving engagement with a crank crown gear 95 that is mounted on crank 55. The crank crown gear 95 thus drives crank 55 into rotation, which drives hip portion 20 into reciprocation through hip transmission member 57. Thus, the motor 72 is in driving engagement with the hip reciprocating means through a hip reciprocation reduction means.

Referring to FIG. 4, a drive wheel pinion gear 96 is mounted on the end of the base movement transmission shaft 94 and drivingly engaged with a drive wheel crown gear 98 that is mounted on one of a pair of drive wheels **100*a* and 100*b* that is coaxially mounted with the drive wheel crown gear 98. Thus, the motor 72 is in driving engagement with the base moving means through a base movement reduction means. In addition, the drive wheels 100*a* and 100*b* are mounted in a drive wheel bracket 102 that is swivelably mounted so that the drive wheels 100*a* and 100*b*** can swivel about a vertical axis.

In order to allow the base movement transmission shaft 94 to rotate independently of the motor crown gear 78 and the motor pinion gear 80, the motor crown gear 78 and motor pinion gear 80 are preferably mounted on a sleeve 79 rotatably mounted on the base movement transmission shaft 94.

Of course, gears different from the various gears described above can be used and are considered to be equivalents. For example, the drive wheel pinion gear 96 and drive wheel crown gear 98 can be replaced with bevel gears, or can be switched so that the drive wheel pinion gear 96 becomes a crown gear and the drive wheel crown gear 98 becomes a pinion gear.

In use, batteries (not shown) will be inserted in the battery compartment 130 and the motor 72 will be activated by the switch 120. Through the disclosed hip reciprocation reduction means and base movement reduction means, the motor 72 will simultaneously drive the crank 55 to reciprocate the hip portion 20 and the drive wheels 100*a* and 100*b* to cause the doll 10 to move along the surface S in a generally curving path. Further, because of the cooperation between the drive wheel pinion gear 96, the drive wheel crown gear 98, and the swivelable mounting of the drive wheel bracket 102, if the doll 10 strikes against an obstacle, the drive wheels 100*a* and 100*b* will cause the drive wheel bracket 102 to rotate and the doll 10 will be driven in a different direction, thus moving around the obstacle.

It is advantageous and desirable to have the doll 10 move in a generally curving path in order to effect a more life like movement. Further, it is preferred that the doll 10 follow a generally curving path so that it will tend to remain in a limited region of the surface S while in use; if the doll 10 moved in a straight path, then it would quickly reach any boundary of the surface S or would bump into obstacles. If a generally curving path is followed, then it will take longer for the doll 10 to bump into any obstacles. Optimally, the generally curving path will have a small radius of curvature, comparable to the radius of the bottom 140 of the base 40 so that the doll 10 does not move far from its initial position after being activated.

Using the preferred embodiment, the doll 10 follows a circular path a significant portion of the time, but often the doll 10 follows an almost randomly curving path. This results in an aesthetically pleasing and lifelike motion along the surface S with the doll 10 sometimes dancing in a circle for a significant part of the time, but then sometimes following a different curving path, including retracing a previously travelled path. When the doll 10 retraces a portion of its previously travelled path, the doll 10 appears to be dancing in one direction, and then in the opposite direction (for example, forwards and then backwards), thus undulating along its general direction of motion, again creating a very pleasing and lifelike effect. Also, the doll sometimes appears to move in one direction, and then to stop, and then to start again, and might repeat this cycle several times, giving the impression of moving along a generally curving path, but stopping and starting while moving.

Accordingly, a doll has been provided that is more life like in imitating the movements of a hula dancer because the doll both reciprocates its hips and moves along a surface in a generally curving path, instead of merely rotating about a stationary base.

While the present invention has been disclosed in connection with the preferred embodiment described above, it should be understood that there may be other embodiments that fall within the spirit and scope of the invention as defined by the claims. For example, and not by way of limitation, the doll could also be provided with a mechanism to make the arms or head move, as disclosed by U.S. Pat. No. 4,875,886 to Sung. For a further example, different reduction, reciprocating and moving means (such as spur gears, bevel gears, crown gears, belts or pulleys) or transmission means (such as shafts, rods, chains, or other members) could be used to accomplish the same results, but such different means are deemed to be equivalent to the disclosed means. Accordingly, no limitations are to be implied or inferred except as expressly and specifically set forth in the attached claims.

INDUSTRIAL APPLICABILITY

This invention is applicable to dancing dolls of all types.

What is claimed is:

1. A doll that moves and dances on a surface, comprising:

a base;

base moving means operatively connected to said base for moving said base along said surface;

a hip portion reciprocatably supported above said base;

hip reciprocating means operatively connected to said hip portion for reciprocating said hip portion;

wherein said base moving means comprises a driving wheel attached to said base and a motor mounted in said base in driving engagement with said driving wheel;

wherein said driving wheel is swivelably mounted to swivel about a vertical axis.

2. A doll according to claim 1, further comprising:

base movement reduction means operably connected between said motor and said base moving means.

3. A doll according to claim 1, wherein said hip reciprocating means comprises:

crank means rotatably mounted in said base; and transmission means having a hip end and a crank end, said hip end being rotatably attached to said hip portion and said crank end being rotatably attached to said crank.

4. A doll according to claim 1, wherein said hip reciprocating means is in driving engagement with said motor.

5. A doll according to claim 1, further comprising: hip movement reduction means operably connected between said motor and said hip reciprocating means.

6. A doll according to claim 4, wherein said motor is an electric motor.

7. A doll according to claim 4, further comprising: sound emitting means mounted in said base for emitting sounds.

8. A doll according to claim 7, wherein said sound emitting means comprises an IC chip and a loudspeaker mounted in said base.

9. A doll according to claim 8, wherein said hip portion resembles the hip portion of a human.

10. A doll according to claim 9, further comprising:

an upper portion supported above said hip portion that resembles the torso of a human;

a head portion movably attached to said upper portion that resembles the head of a human; and two arms movably attached to said upper portion that resemble the arms of a human;

whereby said head portion and said arms can be posed in different positions.

11. A doll that moves and dances, comprising:

a base;

a motor mounted in said base;

a driving wheel swivelably mounted to swivel about a vertical axis mounted on said base and drivingly engaged with said motor, whereby driving said driving wheel causes said base to move in a generally curving path;

base movement reduction means mounted on said base operably connected between said motor and said driving wheel for driving said driving wheel at a desired speed;

a hip portion reciprocatably supported above said base that resembles the hip portion of a human;

crank means rotatably mounted in said base;

transmission means having a hip end and a crank end, said hip end being attached to said hip portion and said crank end being attached to said crank, whereby rotation of said crank causes movement of said hip end and reciprocating movement of said hip portion;

hip reciprocation reduction means operably connected between said motor and said crank for driving said hip reciprocating movement at a desired speed; and an upper portion supported above said hip portion that resembles the torso of a human.

12. A doll according to claim 11, further comprising:

sound emitting means mounted in said base.

13. A doll according to claim 12, further comprising:

clutch means operatively connecting said hip reciprocation reduction means and said base movement reduction means to said motor.

14. A doll according to claim 13, wherein said base has the shape of a truncated cone having a bottom that defines a bottom radius of curvature.

15. A doll according to claim 14, wherein said generally curving path has a radius of curvature comparable to said bottom radius of curvature.

16. A doll that moves and dances on a surface, comprising:

a base;

a motor mounted in said base;

base moving means drivingly engaged with said motor, in direct contact with said surface and operatively connected to said base for moving said base back and forth along said surface along different generally randomly curving paths in a limited region of said surface;

a hip portion reciprocatably supported above said base;

hip reciprocating means operatively connected to said hip portion for reciprocating said hip portion.

17. A doll according to claim 16, wherein said base moving means comprises:

a driving wheel attached to said base drivably engaged with said motor; and two support wheels attached to said base, wherein said driving wheel and said two support wheels define an approximately equilateral triangle.

18. A doll according to claim 16, further comprising:

an upper portion supported above said hip portion that resembles the torso of a human.

* * * * *